US005308157A

United States Patent [19]

Dyer

[11] Patent Number: 5,308,157

[45] Date of Patent: May 3, 1994

[54] FOLDABLE STRUCTURES

[76] Inventor: David C. Dyer, 25B London Road, Hertford SG13 7RL, England

[21] Appl. No.: 777,219

[22] PCT Filed: May 4, 1990

[86] PCT No.: PCT/GB90/00697

§ 371 Date: Jan. 3, 1992

§ 102(e) Date: Jan. 3, 1992

[87] PCT Pub. No.: WO90/13241

PCT Pub. Date: Nov. 15, 1990

[30] Foreign Application Priority Data

May 4, 1989 [GB] United Kingdom ..... 8910228

[51] Int. Cl.[5] ..... A47B 43/00

[52] U.S. Cl. ..... 312/258; 220/6

[58] Field of Search ..... 312/258; 126/9 A, 9 B, 126/29, 19 M, 59; 220/6

[56] References Cited

U.S. PATENT DOCUMENTS 1,487,582 3/1924 Latta ..... 220/6
1,534,672 4/1925 Stewart ..... 220/6
1,620.143 3/1927 Trimble ..... 220/6
2,305,629 12/1942 Magnuson et al. .

FOREIGN PATENT DOCUMENTS 1200200 9/1965 Fed. Rep. of Germany .
2055290 3/1981 United Kingdom .
2179698 3/1987 United Kingdom .

OTHER PUBLICATIONS

Systeme D +Les Cahiers de Systeme D, No. 389, Jun. 1978 (Paris, FR), L. Houdayer: "Un buffet pliant", pp. 118–119, see the whole article.

*Primary Examiner*—Kenneth J. Dorner
*Assistant Examiner*—Gerald Anderson
*Attorney, Agent, or Firm*—Cushman, Darby & Cushman

[57] ABSTRACT

A foldable structure which can be used as the basis for a wide variety of articles, such as furniture, office equipment, freight containers and portable buildings, is foldable between a generally flat form and an erected, three-dimensional form. A first pair of opposed frame units (10,11) are connected by at least one further frame unit (12), which is hingedly attached to one (11) of the pair of frame units and is hingedly and slidably attached to the other (10) of the pair of frame units, for example by means of swivel cleats (13). Further components are connected to one or both of the pair of frame units (10,11) so that such further components can be disposed in a folded-flat position adjacent to said pair of frame units (10,11) when the latter are in their collapsed state and can be disposed in a second, ready-for-use position in planes at an angle to the planes containing the frame units to which they are attached.

4 Claims, 7 Drawing Sheets

FIG. 2.
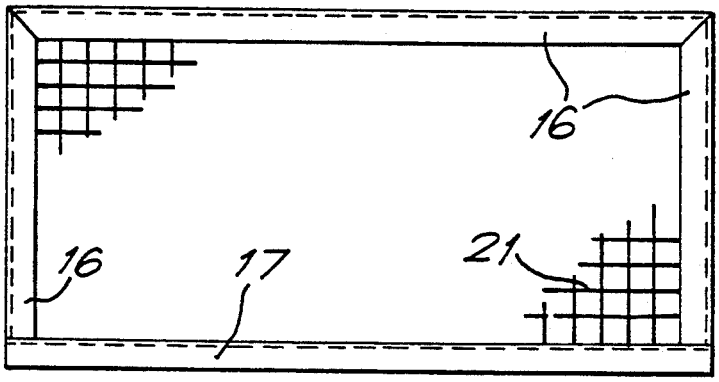
FIG. 3.
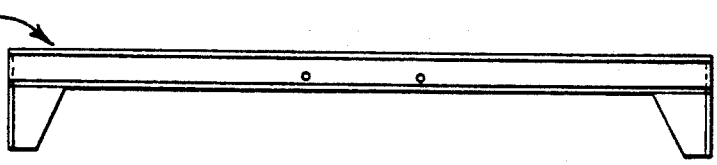
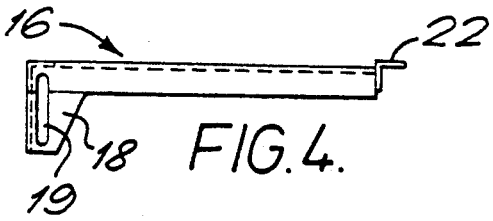
FIG. 4.
FIG. 4A.
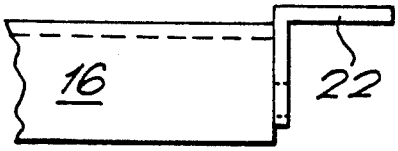
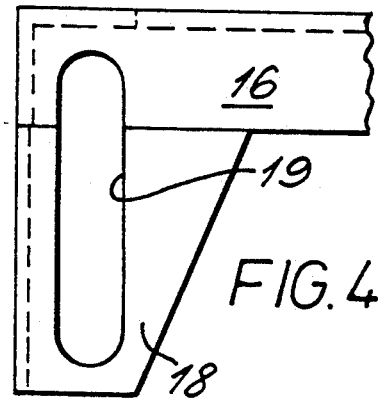
FIG. 4B.
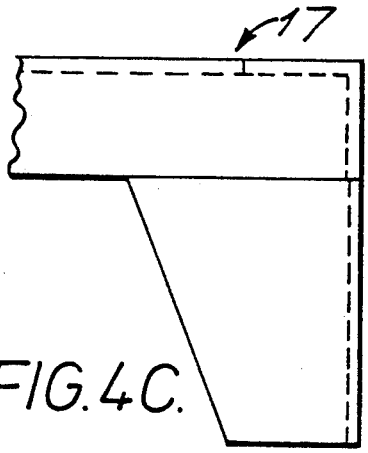
FIG. 4C.

36
30
34
31

36
38
34
31
30

40
36
39
38
33
34
31
33
30

36
31
35
34
30

48
48
31
32
33
44
45
30
46
46
43
33
49

50
35
51

FIG. 7A.
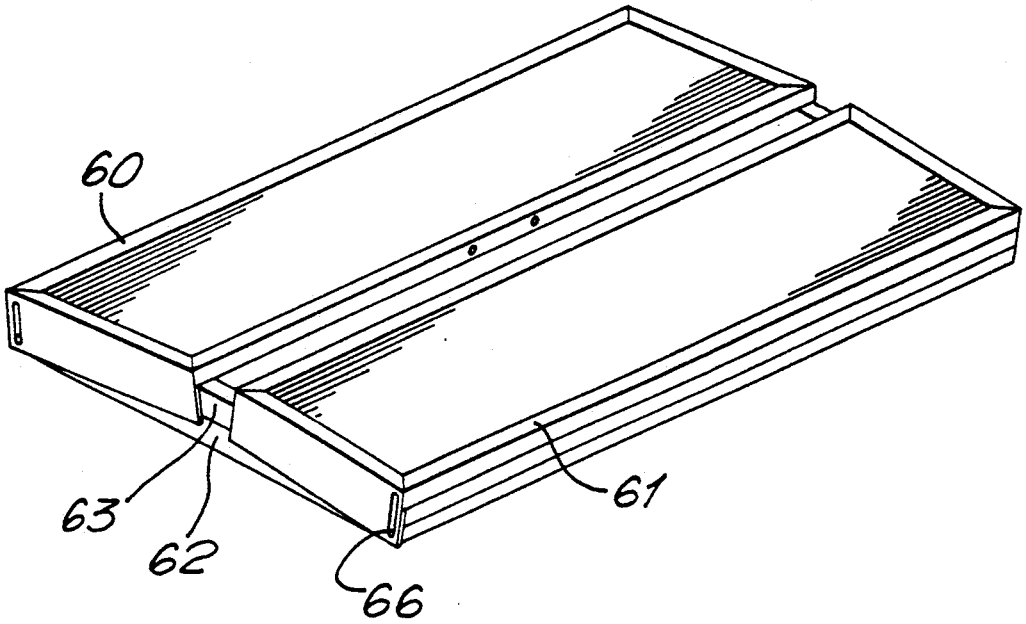
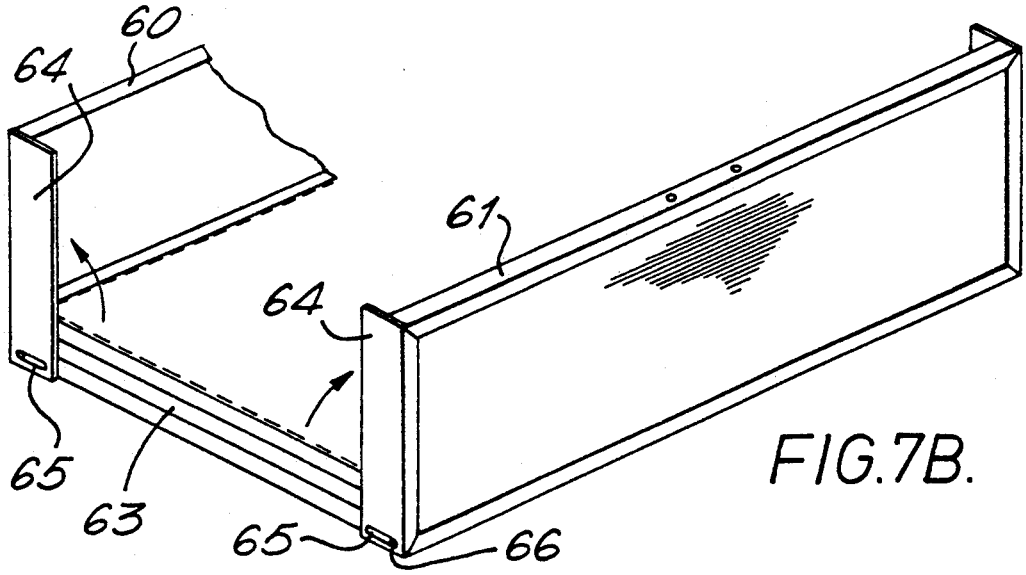
FIG. 7B.

FOLDABLE STRUCTURES

BACKGROUND OF THE INVENTION

1. Field of the Invention

This invention relates to foldable structures, which can be used as the basis for a wide range of domestic furniture items, office equipment, workshop and industrial units, freight containers and portable buildings, by way of example. An important principle in the construction and operation of the foldable structures of the invention is the ability to change a framework or foldable structure from a generally flat and essentially two-dimensional form into an erect three-dimensional form.

2. Description of the Prior Art

The present invention results from further development in the uses of swivel cleats as the connections between the relatively hingeable components of collapsible frameworks, such as are disclosed in GB-2055290B and GB-2179698B. These prior disclosures relate to collapsible structures which incorporate such frameworks and to swivel cleats used in their construction.

It has now been discovered that foldable structures of improved versatility and utility can be made on the basis of collapsible frameworks of the kind mentioned above, which have additional components of the frameworks and with any panel units attached to or incorporated in them. As will be made apparent below, the foldable structures of the present invention can include frame units, e.g. rectangular arrangements of bars or rods, panels attached to frames or panels per se, and carrying means for attachment to other frame units or other panels.

The foldable structures of the invention can be embodied in a wide variety of articles and systems, where there is a need for the structures to be stored, transported and delivered in a flat condition and then to be erected, in a very short time and very easily, into a three-dimensional configuration, to enable the articles or systems to be used.

SUMMARY OF THE INVENTION

It is an object of the invention to provide foldable structures which are space-saving, in that they can be folded flat. The foldable structures can be assembled quickly without the need for special tools, nuts, bolts or adhesives. Each foldable unit can be pulled into position with a concertina-like action to form a rigid structure. All the foldable structures can be manufactured in wood, metal or composites, with durable, high quality finishes. The foldable structures are robust, and easily stored when not required for use.

Among the products which can be made with the foldable structures of the present invention are desks, cabinets, racking systems, kitchen units, tables, security cages for construction equipment, access towers for construction sites, sheds for gardens and general storage, outdoor furniture and portable buildings for temporary or permanent use. These are examples only of the products which can be made with these foldable structures.

According to one aspect of the present invention, a foldable structure comprises a first pair of opposed frame units which are operatively interconnected by at least one further frame unit, which is hingedly attached to one of the first pair of frame units and hingedly and slidably attached to or associated with the other of the first pair of frame units, wherein a further component of the foldable structure is connected to at least one of the first pair of frame units by connection means, whereby the further component can be disposed in a first, out-of-use folded position adjacent to the first pair of opposed frame units when in their collapsed state and alternatively can be disposed in a second, ready-for-use position in a plane at an angle to the plane containing the frame unit to which it is attached.

According to a further aspect of the present invention, a foldable structure comprises at least a first pair of opposed frame units interconnected by at least one further frame unit hingedly connected to one of the first pair of frame units and hingedly and slidably interconnected with the other of the first pair of frame units, wherein the opposed pair of frame units are disposed generally vertically when the foldable structure is disposed in an erected, ready-for-use configuration, with relative sliding movement between one of the first pair of frame units and the further frame unit or units interconnecting it with the other of the first pair of frame units taking place in an upward or downward vertical direction, and wherein a further component arranged to define a generally horizontal portion of the structure when in use is hingedly attached to one of the pair of opposed frame units by connection means allowing relative movement therebetween as the foldable structure is changed from a generally flat configuration to an erected ready-for-use configuration.

According to a further aspect of the invention, a foldable structure comprises at least a first pair of opposed frame units interconnected by at least one further frame unit hingedly connected to one of the first pair of frame units and hingedly and slidably interconnected with the other of the first pair of frame units, wherein the opposed pair of frame units are disposed generally vertically when the foldable structure is disposed in an erected, ready-for-use configuration, with relative sliding movement between one of the first pair of frame units and the further frame unit or units interconnecting it with the other of the first pair of frame units taking place as reciprocating movement in a generally horizontal direction, and wherein a further component arranged to define a generally horizontal portion of the structure when in use is hingedly attached to one of the pair of opposed frame units by connection means allowing relative movement therebetween as the foldable structure is changed from a generally flat configuration to an erected ready-for-use configuration.

Preferably, said at least one further frame unit is connected by swivel cleats to the adjacent frame unit of the opposed frame units.

Preferably, panel members are incorporated in or are attachable to each of the frame units, whereby a structure comprising base, top, front, back and opposed side panel members can be collapsed into a generally flat configuration while the front and back panel members remain substantially parallel to each other.

In order that the invention may be more readily understood, representative embodiments of various aspects of the present invention are described below, by way of illustration only, in conjunction with the accompanying drawings. In the drawings:

BRIEF DESCRIPTION OF THE DRAWINGS

FIG. 2 shows a plan view of the security cage of FIG. 1; and

FIG. 3 shows an elevational view of the top panel thereof;

FIG. 4 shows a detailed view of the top panel inside view, along the line of the arrows C—C in FIG. 3;

FIG. 4A shows, on an enlarged scale, the right-hand end portion of FIG. 4;

FIG. 4B shows, also on an enlarged scale, the left-hand end portion of FIG. 4;

FIG. 4C shows on the same scale a side view looking at FIG. 4B from the left-hand end;

FIG. 7A shows a freight container according to the invention in a folded-down state;

FIG. 7B shows the container of FIG. 7A with the bottom and top unfolded;

FIG. 7C shows the container of FIGS. 7A and 7B with the front frame being raised into place;

DETAILED DESCRIPTION OF THE PREFERRED EMBODIMENTS

Figures 1, 1A, 1B, 1C:
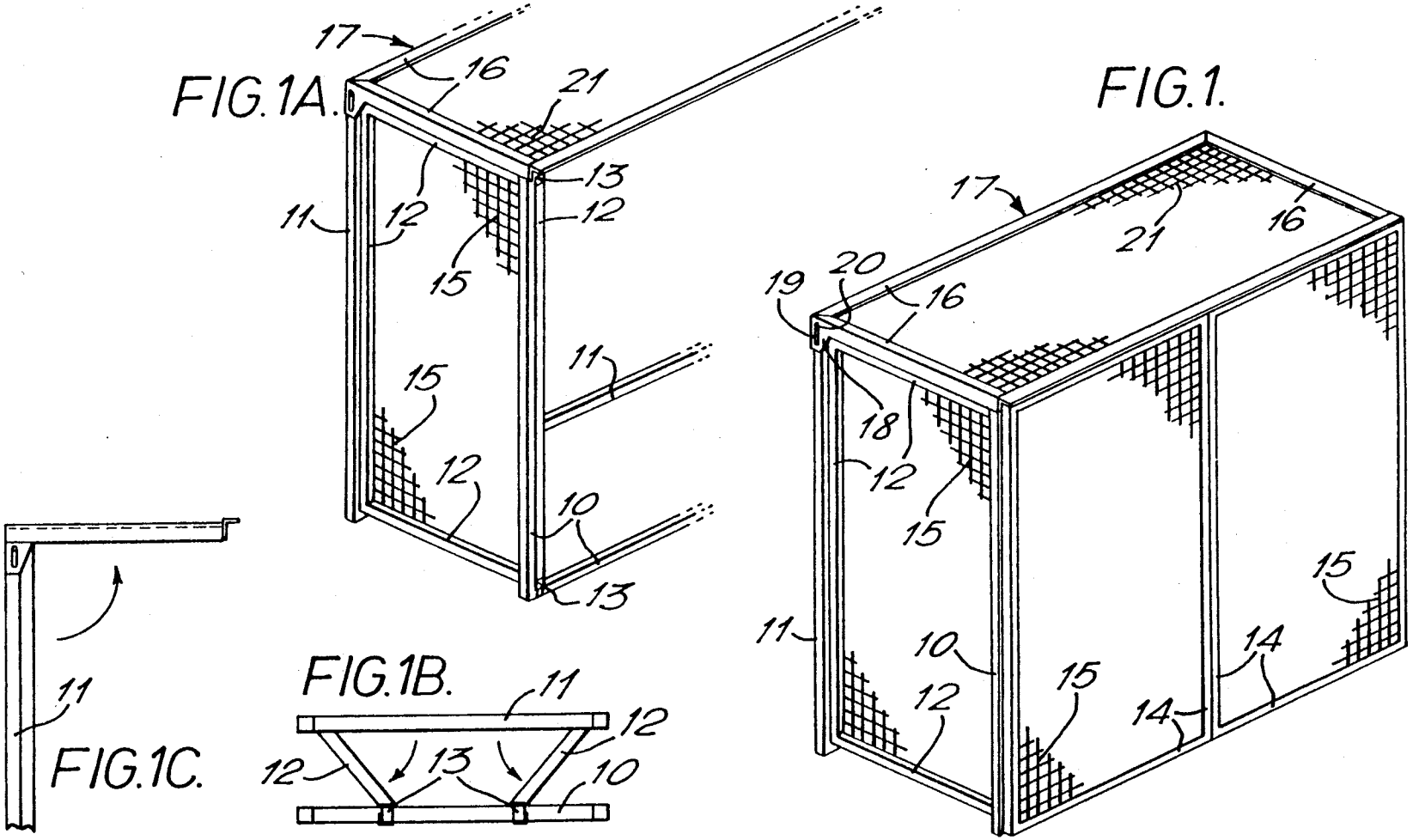
FIG. 1 shows in diagrammatic perspective view a foldable structure according to the invention comprising a number of rectangular frame units or members, each frame member incorporating a mesh structure and serving for instance as part of a security or safety cage.
FIG. 1A shows a view of a security cage similar to that shown in FIG. 1, but without one or more of the members forming the front of the cage, to illustrate inter alia a modular principle by which larger structures can be made.
FIG. 1B shows in diagrammatic view a plan of the foldable structure on FIG. 1 with the top removed, during transition from the collapsed to the erected state.
FIG. 1C similarly shows in detail how a top panel of the security cages of FIGS. 1 and 1A can be hinged up into its ready-for-use position when the foldable structure has itself been erected.

Referring first to FIG. 1, a foldable structure comprises an opposed pair of front and back rectangular frame members, the front member being indicated at 10 and the rear (back) member at 11. Each of the frame members 10, 11 consists of opposed pairs of side uprights, an interconnecting horizontal at the bottom and an interconnecting horizontal at the top. The front and rear frames 10, 11 in the collapsed state lie adjacent to one another, essentially flat and in the same plane, and can be erected into the condition shown in FIG. 1 by the motion of an opposed pair of side frames 12 interconnecting them. Each side frame 12 also consists of a pair of opposed side members connected by bottom and top horizontals. Each side frame 12 is hingedly attached to the rear frame 11 and hingedly and slidably attached to the front frame 10, by means of swivel cleats 13, as shown most clearly in FIG. 1B. The swivel cleats may be of the form shown and described in GB-2179698B. A pair of rectangular sub-frames 14 are provided, as a pair of front doors, and are hingedly attached in normal manner, by means of their outer side members, to the side members of the front frame 10. In order to form a security cage, wire mesh panels 15 are secured as by welding at their edges to appropriate parts on the frame members, which therefore are also made of metal capable of being welded to the wire of the panels 15. The panels 15 are secured to the front, rear and side frames 10, 11, 12 and to the sub-frames 14. Generally, it is unnecessary to enclose the base of the folding structure, particularly if this is designed to be fixed to the ground.

In order to enclose the top of the foldable structure, a top frame 16 is hingedly and displaceably attached, for instance at its rear frame component 17, to the top horizontal of the rear frame 11. For this purpose, each corner of the top frame 16 is provided with a dependent lug 18 having a vertical slot 19 formed in it, i.e. in a direction generally at right-angles to the plane of the top frame 16. Each slot 19 in one of the opposed pair of lugs 18, thus provided one at each rear corner of the top frame 16, is fitted over a pin 20, described in detail below and secured to the upper portion of the side members of the rear frame 11. The top frame 16 also includes a mesh panel 21, similar to the mesh panels 15. The foldable structure shown in FIG. 1A is similar to that shown in FIG. 1, except that the sub-frames 14 forming the doors are omitted to allow the interior construction to be seen and also to serve as a second or subsidiary modular foldable structure for association with the first if required. For instance, a rear panel need not be provided on the foldable structure of FIG. 1.

As best shown in FIG. 4, the top frame 16 incorporates an L-section member 22 at its front, which overlies the sub-frames 14 when the doors are closed. With the foldable structures illustrated in FIGS. 1 to 4C inclusive, it will be appreciated that the opposed front and rear frames 10, 11, forming a first pair of opposed frames, generally remain upright and parallel to one another as they move from the face-to-face contact position, i.e. when the structure is folded flat, into the erected and mutually-spaced condition, i.e. when the structure is opened out ready for use. The side frames 12 are hingedly attached to the rear frame 11 and thus pivot about essentially vertical axes, while the swivel cleats 13 hingedly and slidably interconnecting the side frames 12 with the front frame 10 also hinge about vertical axes, as the folding structure is changed from one configuration to the other.

By way of contrast, in the foldable structure illustrated in FIGS. 5A to 5D, 6 and 6A, the axes about which hinging of the frames forming the foldable structure takes place are essentially horizontal. The foldable structure shown in FIGS. 5A to 5D, 6 and 6A thus comprises a front frame 30 and a rear (back) frame 31 which are normally disposed in vertical planes. When the structure is folded flat (FIG. 5A), the frames 30, 31 are in face-to-face contact and are essentially located in the same vertical plane.

Figures 5A, 5B, 5C, 5D, 6, 6A:
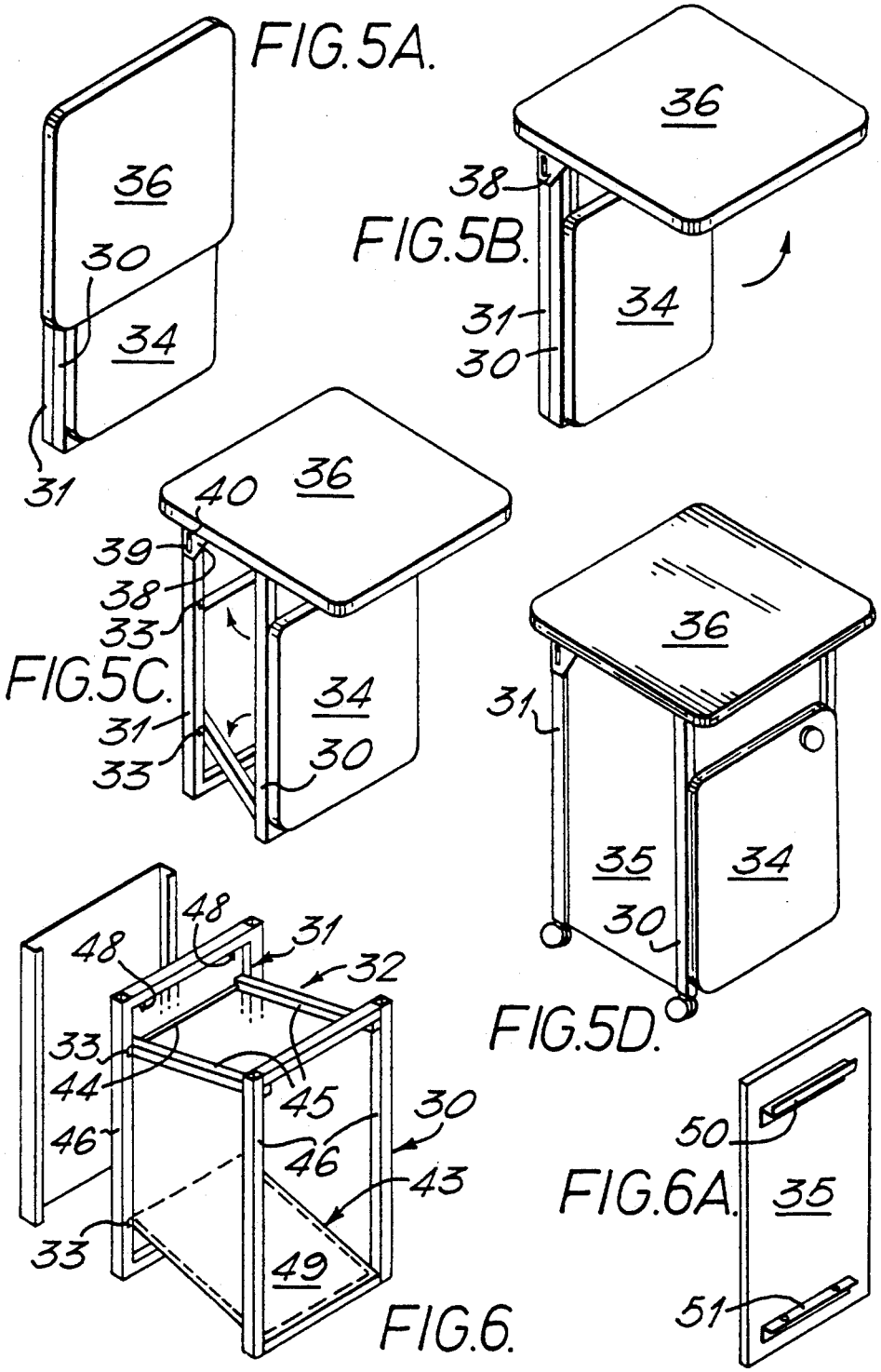
FIGS. 5A, 5B, 5C and 5D show a cabinet with shelf and cupboard, respectively in the fully collapsed flat state, with the top panel folded up for use, with the front frame unfolding relative to the back frame, and in the fully-erected condition.
FIG. 6 shows in diagrammatic perspective view the framework structure of the furniture item of FIGS. 5A to 5D and its association with a back panel.
FIG. 6A shows in diagrammatic perspective view a side panel for association with the foldable structures of FIGS. 5A to 5D and 6.

As most clearly shown in FIG. 6, the front frame 30 is connected to the rear frame 31 by a top frame 32, consisting of an opposed pair of side members 45 which are hinged at their front ends to the uprights 46 of the front frame 30 and which are slidably and hingedly connected to the uprights 46 of the rear frame 31 by means of two swivel cleats 33. The rear ends of the side members 45 are joined by a rear rod 44 which, when the top frame 32 reaches its horizontal position, engages behind spring clips 48 attached to the top of the rear frame 31 and designed to hold the frames in the erected condition. Similarly, the front and rear frames 30, 31 are interconnected by a bottom frame 43 mounted similarly to hinge at the front and hinge and slide at the rear. The bottom frame 43 supports a bottom panel 49. As the cabinet shown in these drawings is changed from its flat configuration shown in FIG. 5A to the erected configuration shown in FIG. 5D, the top and bottom frames 32, 43 hinge relative to the front and rear frames 30, 31, as best shown in FIG. 5C and FIG. 6. The cabinet is completed by means of a rear panel, a top panel 36, hinged to the top of the rear frame 31 by means of lugs 38 containing slots 39 which engage over pins 40, and an opposed pair of side panels 35, an inside view of one of which is shown in FIG. 6A. Each side panel 35 includes a Z-section angle member 50 and an L-section angle member 51, which respectively engage with the side members 45 and the adjacent edge of the bottom panel 49, when the foldable structure has been fully erected.

Figure 7D:
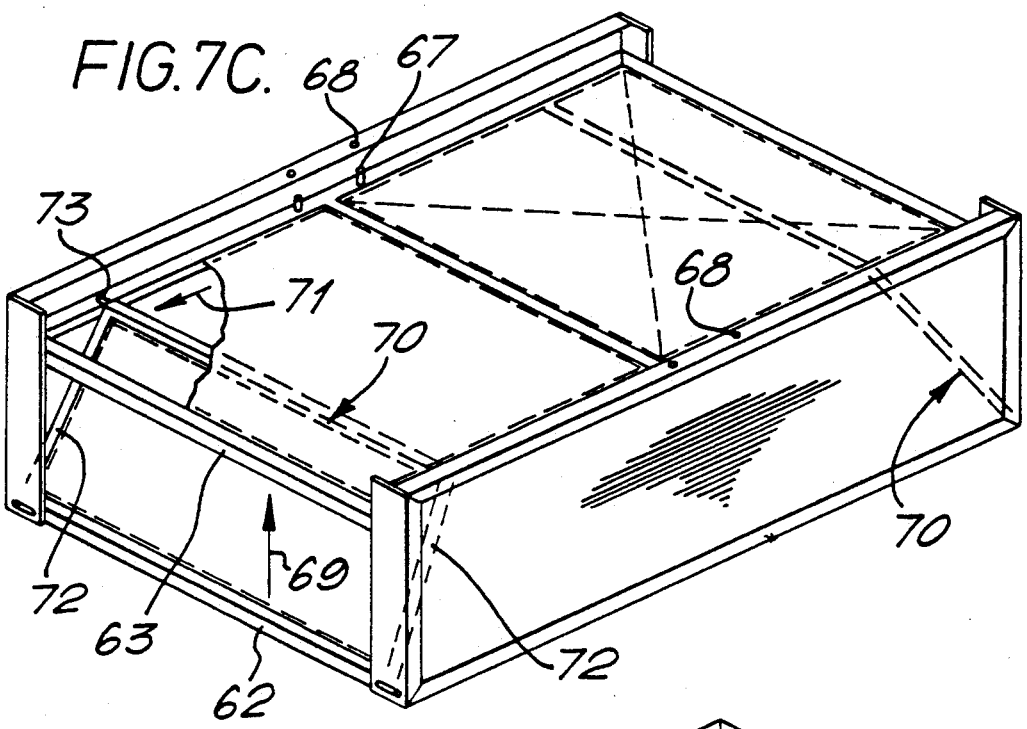
FIG. 7D shows the container in its fully erected state, and turned over through 90° as compared with FIGS. 7A to 7C.
Figure 7D:
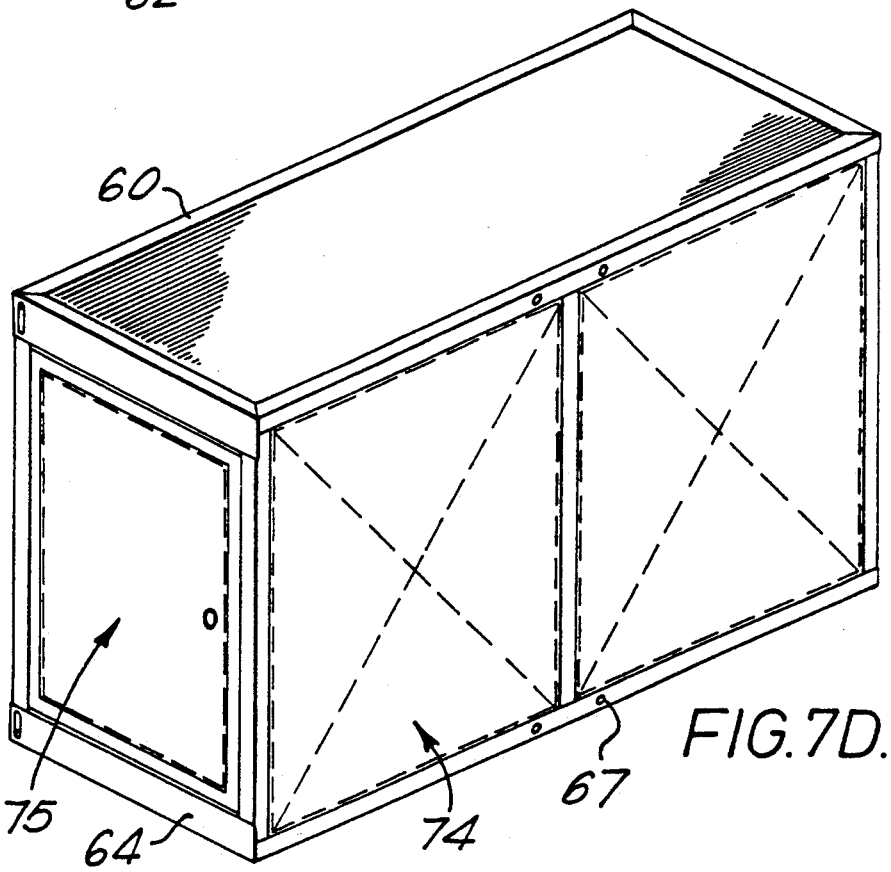

Referring now to FIGS. 7A to 7D, there is shown a foldable structure designed as a freight container. FIG. 7A shows the container in a substantially fully folded-down position. The container comprises a top frame 60, a bottom frame 61, a rear frame 62 and a front frame 63. The top and bottom frames 60, 61 are each provided at each end with flange plates 64 which are each provided with a slot 65 which engages with a pivot pin 66 fitted to the rear frame 62. By this connection means, when the top and bottom frames are unfolded, as indicated by the arrows in FIG. 7B, into their erected positions, the connection permits pivotable movement and translational movement to be effected between the top and bottom frames on the one hand and the rear frame on the other hand.

FIG. 7C shows the next stage in the process of erecting the container. Here, the front frame 63 has been raised most of the way towards its final position. When it is fully raised, security pins 67 on the front frame engage in corresponding holes 68 in the longer members of the top and bottom frames 60, 61. As can be seen from FIG. 7C, as the front frame 63 is raised in the direction of arrow 69, two side frames, indicated generally at 70, are moved towards an erected position in which they complete the box formation of the container. The arrow 71 indicates the direction of movement of one side frame 70. The side frames 70, in a manner analogous to the earlier embodiments, have their shorter side pieces 72 hingedly connected to the rear frame 62 at one end and hingedly and slidably attached to the front frame 63 at their other ends, again by swivel cleats 73. In this way, as the front frame is raised, the two side frames 70 move from their folded flat position to a position in which they complete the sides of the container.

FIG. 7D shows the container fully assembled. From the position shown in FIG. 7C the container is turned through 90° so that the top frame 60 is now uppermost. The side frames 70 are secured to the front frame 63 when the swivel cleats 73 have reached their final positions. This can be by means of spring clips for example. As shown in FIG. 7D the container has sheet steel cladding indicated generally at 74 on the front frame and has a door 75 fitted to the one side frame. The container is preferably manufactured from steel, using steel tube and steel sheet components. However, other materials could be used.

Figure 8A:
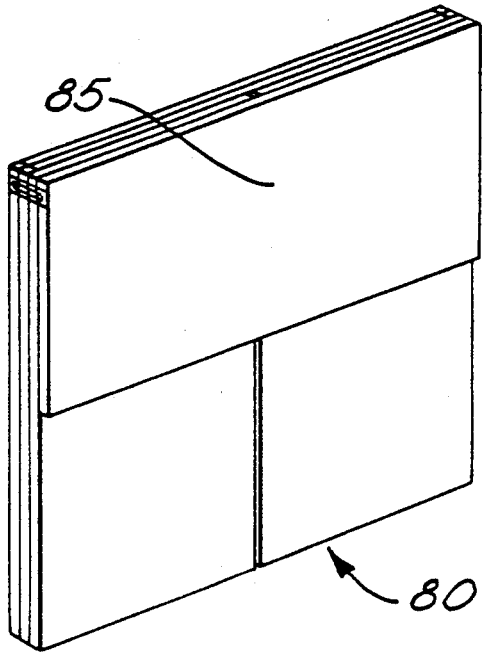
FIG. 8A shows one module, in folded flat condition, suitable for use as part of a building structure according to the invention.
Figure 8B:
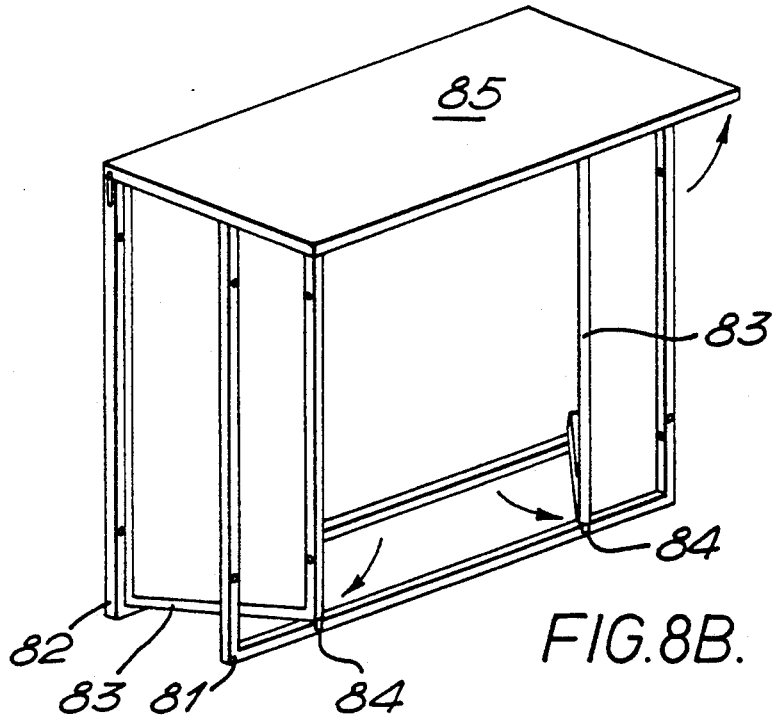
FIG. 8B shows the module of FIG. 8A in a partially unfolded state, without doors.

Referring now to FIGS. 8A and 8B, there is shown a module, indicated generally at 80, which is shown in its folded flat condition in FIG. 8A. FIG. 8B shows the module in a partially unfolded state, without doors. The arrows indicate the direction of unfolding of the component parts. As shown in FIG. 8B, the module comprises a front frame 81, a rear frame 82, and a pair of side frames 83 which, as in the embodiments described above, are hingedly connected to the rear frame and are hingedly and slidably connected to the front frame 81 by swivel cleats 84. The basic frame structure 81, 82, 83 is provided with a further component 85, which here constitutes a top panel and which as shown in FIG. 8A folds down flat against the other parts of the structure. The top panel 85 is connected to the rear frame 82 by a slot and pin connection which permits pivotal and translational movement of the two parts relative to each other as the structure is unfolded.

Figure 9:
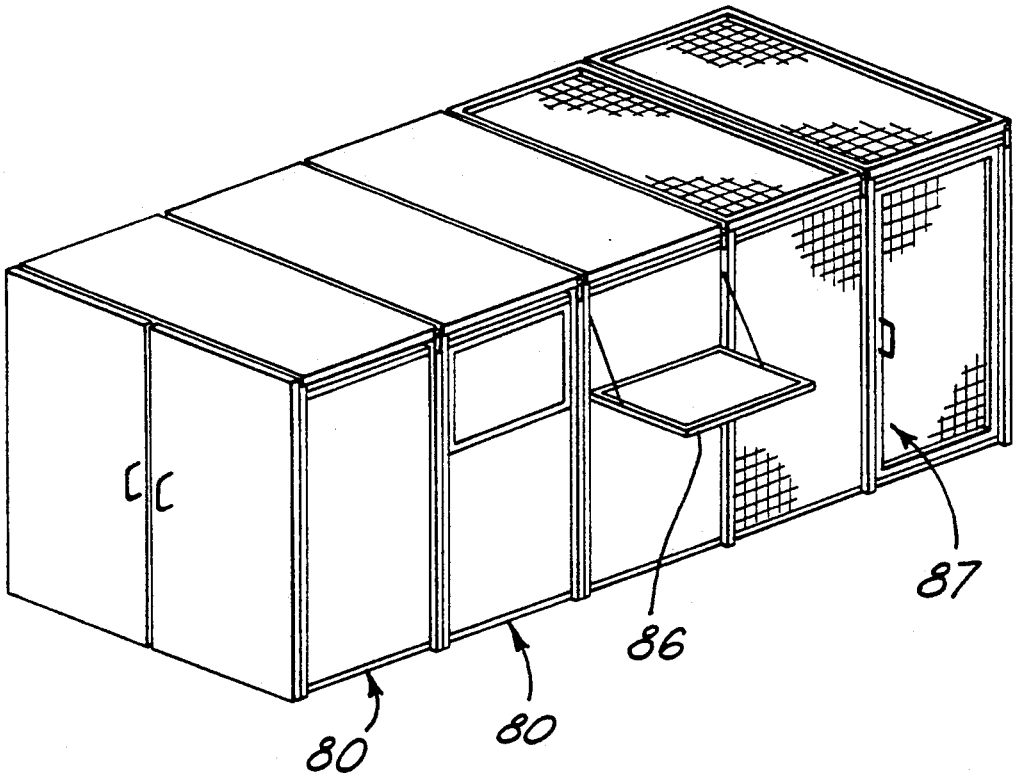
FIG. 9 shows an accommodation unit comprising a plurality of modules according to FIGS. 8A and 8B.

FIG. 9 shows a building structure which can be made up from a plurality of the modules 80 shown in FIGS. 8A and 8B. The erected modules are positioned side-by-side and are then connected to each other by suitable means, for example by using over-centre clips. Alternatively, the modules can be bolted together. The modules can be of the same or different designs, with a number of different features being shown in FIG. 9. These include a pull-down flap 86 and a wire mesh door 87. Because the individual modules are complete in themselves and have no loose nuts, bolts, etc., it is possible to erect the individual modules from the fully folded flat position to the fully erected position in about 12 seconds, with the subsequent connection together of the individual modules taking a matter of a few minutes. It is thus possible very quickly and easily to provide units of this nature for permanent or temporary accommodation for example and for storage purposes.

As a further development of the arrangement shown in FIG. 9, one can design a structure which is not "linear" but which extends in two or more directions at an angle to each other. This is achieved by connecting two or more sets of such modules by corner modules which comprise a simple triangular framework having a vertical hinge connection at one corner of the triangle and swivel cleats between two of the sides, thus permitting the triangular module to be folded flat or erected into the triangular configuration. The triangular module then is positioned between two "linear" arrays of modules 80.

I claim:

1. A foldable structure comprising:

a front frame;

a top frame;

a back frame being parallel to said front frame;

a first side frame hingedly attached to said front frame and by a first pair of slidable and hingeable swivel cleats;

a second side frame hingedly attached to said front frame and slidably and hingedly attached to said back frame by a second pair of swivel cleats, said first side frame and said second side frame being adapted for simultaneous movement so as to expand the foldable structure into an erected box configuration when said first side frame and said second side frame are moved parallel to each other and to collapse the foldable structure into a flat collapsed configuration when sliding and hinging ends of said first side frame and said second side frame are moved toward each other;

connection means for connecting said top frame to one of said front frame and back frame when the foldable structure is in said flat collapsed configuration, said top frame being movable to be at right angles to said front frame and being disposed on said front frame so as to prevent movement of said front and back frames relative to each other and to form a top to the foldable structure when the foldable structure is in said erected box configuration; and a plurality of panels, one of each being attached to said front, back, first side, second side, and top frames, said panels enclosing said frames such that the foldable structure is an enclosed rectangular container when in said erected box configuration and said front frame is vertically disposed whereby the foldable structure can be collapsed into a flat collapsed configuration when said panels are attached to said frames.

2. A foldable structure as recited in claim 1 further comprising:

a bottom frame having a panel attached thereto and enclosing said bottom frame, said bottom frame being connected to one of said front frames and said back frame by said connection means, said bottom frame being parallel to said front frame and said back frame when the foldable structure is in said flat collapsed configuration, said bottom frame being movable to be at right angles to said front frame and being adjacent to said back frame when the foldable structure is in said erected box configuration so as to form a bottom to the foldable structure such that the foldable structure is completely enclosed on all sides when the foldable structure is in said erected box configuration.

3. A foldable structure as recited in claim 2, wherein said connection means permits relative pivotal movement and relative translational movement of said top frame and said bottom frame with one of said front frame and said back frame.

4. A foldable structure as recited in claim 3, wherein said connection means includes interengaging pin and slot couplings.

* * * * *